US009962955B2

(12) United States Patent
Collett

(10) Patent No.: US 9,962,955 B2
(45) Date of Patent: May 8, 2018

(54) NAIL ART PRINTING APPARATUS

(71) Applicant: LOFT CRAG LIMITED, Castletown (GB)

(72) Inventor: Judy Collett, Belfast (GB)

(73) Assignee: LOFT CRAG LIMITED, Castletown (GB)

( * ) Notice: Subject to any disclaimer, the term of this patent is extended or adjusted under 35 U.S.C. 154(b) by 0 days. days.

(21) Appl. No.: 15/308,231

(22) PCT Filed: May 1, 2015

(86) PCT No.: PCT/EP2015/059631
§ 371 (c)(1),
(2) Date: Nov. 1, 2016

(87) PCT Pub. No.: WO2015/166104
PCT Pub. Date: Nov. 5, 2015

(65) Prior Publication Data

US 2017/0072702 A1 Mar. 16, 2017

Related U.S. Application Data

(60) Provisional application No. 61/987,124, filed on May 1, 2014.

(30) Foreign Application Priority Data

May 1, 2014 (GB) ..... 1407735.8

(51) Int. Cl.
*B41J 3/407* (2006.01)
*A45D 29/22* (2006.01)
(Continued)

(52) U.S. Cl.
CPC ..... *B41J 3/407* (2013.01); *B41J 3/445* (2013.01); *A45D 29/22* (2013.01); *A45D 2029/005* (2013.01)

(58) Field of Classification Search
CPC .. A45D 2029/005; A45D 29/22; A45D 29/00; A45D 29/004; B41J 3/407; A61Q 3/02
See application file for complete search history.

(56) References Cited

U.S. PATENT DOCUMENTS 6,336,694 B1 1/2002 Ishizaka
8,820,866 B2 * 9/2014 Kasahara ..... B41J 3/407 347/106

(Continued)

FOREIGN PATENT DOCUMENTS

KR 2005110422 * 11/2005 ..... A45D 29/18
KR 1408863 * 6/2014 ..... A45D 29/00

OTHER PUBLICATIONS

International Preliminary Report on Patentability dated Nov. 1, 2016.

(Continued)

*Primary Examiner* — Huan Tran
(74) *Attorney, Agent, or Firm* — Preston Smirman; Smirman IP Law, PLLC

(57) ABSTRACT

A nail art printing apparatus having a receiving device for the placement of a nail or plurality of nails, the nail art printing apparatus being connectable to an electronic device. The electronic device has a user interface means being operably engagable with the nail art printing apparatus. The nail art printing apparatus being operable to apply a plurality of colors and/or designs to one or more natural and/or artificial nails.

20 Claims, 10 Drawing Sheets

(51) Int. Cl.
*B41J 3/44* (2006.01)
*A45D 29/00* (2006.01)

(56) References Cited

U.S. PATENT DOCUMENTS

| | | | | |
|---|---|---|---|---|
| 9,139,021 | B2 * | 9/2015 | Nakajima | B41J 3/4073 |
| 2013/0019799 | A1 | 1/2013 | Bitoh | |
| 2013/0038647 | A1 | 2/2013 | Hashimoto | |
| 2014/0232802 | A1 * | 8/2014 | Bitoh | B41J 2/49<br>347/110 |
| 2015/0128981 | A1 * | 5/2015 | Asako | A45D 29/00<br>132/200 |
| 2015/0136164 | A1 * | 5/2015 | Yi | A45D 29/00<br>132/200 |
| 2015/0182001 | A1 * | 7/2015 | Yi | A45D 29/00<br>132/200 |
| 2015/0201734 | A1 * | 7/2015 | Yamasaki | A45D 34/04<br>132/200 |
| 2015/0335131 | A1 * | 11/2015 | Ortiz | A45D 29/00<br>132/73.6 |

OTHER PUBLICATIONS

International Search Report dated Nov. 28, 2015.
Written Opinion of the International Searching Authority dated Nov. 28, 2015.

* cited by examiner

NAIL ART PRINTING APPARATUS

CROSS-REFERENCE TO RELATED APPLICATION

The instant application is a national phase of PCT International Application No. PCT/EP2015/059631 filed May 1, 2015, and claims priority to GB Patent Application Serial No. 1407735.8 filed May 1, 2014, and U.S. Provisional Patent Application Ser. No. 61/987,124 filed May 1, 2014, the entire specifications of all of which are expressly incorporated herein by reference.

The present invention relates to a nail art printing apparatus and in particular to a nail art printing apparatus to apply nail art to a plurality of user's natural and artificial nails.

It is common practice for the application of nail art to both natural and artificial nails to be applied manually, requiring brushes, various containers of nail polish colours and a considerable amount of time and skill on the part of the applicator. Self-application would typically be the most popular method of applying nail art and this would usually only comprise the application of one colour due to the difficulty and skill required to accurately create specific designs on a nail. Also due to the universal individual preference for a particular hand (right-handed/left-handed) it is more difficult to self-apply nail art to the more dominant hand and thus it could typically take up to 30 minutes to apply a simple one or two tone design and an hour or more to apply a detailed design.

Alternatively people desiring very detailed or precise nail art would have to visit a beautician/nail technician in order to achieve this and this brings added costs and still requires a considerable amount of time. The more detail that is required the more expensive the service and also for the employer the increased amount of time that one employee has to spend on one customer. For example a typical application of intricate nail art by a beautician/nail technician requires a base coat before any colour or artwork is applied, subsequently both the customer and beautician/nail technician must wait for the base coat to dry. Once the base coat is dry the beautician/nail technician will start applying the customers desired design using brushes and a plurality of colours and depending on the complexity of the design, this will again take a considerable amount of time before another waiting period to allow the nail art to dry. The treatment concludes with a top coat to protect the nails which requires a further waiting period to allow for drying.

In recent years nail art printing kiosks have been becoming more and more common. These are devices which are typically installed in public places such as airports/shopping centres/chemists which allow a user to interact with a computing device enclosed in the kiosk. They operate by a user selecting a design they wish to be printed on their nails, they then insert their fingers into a receiving receptacle and a printing apparatus applies their chosen design onto their natural nails. These types of systems provide multiple advantages over manual application such as the increased speed due to the electronic printing and they are also cheaper as a beautician/nail technician is not required to operate the machine. However these machines often have difficulty printing onto the natural nails due to the significant variance that can exist between multiple user's nails.

It is an object of the present invention to obviate these problems by providing a nail art printing means which can rapidly print nail art designs onto a plurality of natural and/or artificial nails.

Accordingly, the present invention provides a nail art printing apparatus having a receiving means for the placement of a nail or plurality of nails, the nail art printing apparatus being connectable to an electronic device, the electronic device having an interface means being operably engagable with the nail art printing apparatus, the nail art printing apparatus being operable to apply a plurality of colours and/or designs to one or more natural and/or artificial nails.

Ideally, the nail art printing apparatus comprising an electronic device and printing apparatus.

Preferably, the nail art printing apparatus being housed in an enclosure.

Preferably, the enclosure is free standing.

Ideally, the printing apparatus comprising a printer.

Preferably, the printer is an inkjet printer.

Ideally, the printer being of multi-headed design.

Preferably, the printer is a thermal inkjet printer.

Preferably, the printer having a scanning means.

Ideally, the nail art printing apparatus having a scanning means.

Ideally, the scanning means being operable to scan the one or more fingers of the user for accurate printing of the nail art.

Ideally, the scanning means being operable to scan the one or more fingers, or the natural and/or artificial nails thereof, of the user for accurate printing of the nail art.

Preferably, the printer having a presence sensor for detecting the presence of one or more nails.

Ideally, the printing apparatus having a presence sensor for detecting the presence of one or more nails.

Ideally, the presence sensor comprising but not limited to a pressure sensor/optical sensor.

Ideally, the presence sensor output being operably coupled to firmware.

Preferably, the printer being connectable to a microcontroller.

Preferably, the firmware being installed on the microcontroller.

Ideally, the presence sensor being connectable to the microcontroller.

Ideally, the printer being operable to print onto one or more natural and/or artificial nails under the control of the microcontroller upon the detection of the presence of one or more fingers/nails via the presence sensor.

Preferably, the microcontroller is connectable to the electronic device.

Ideally, the firmware is configured to instruct the scanner to map the printable surface defined by one or more natural and/or artificial nails.

Preferably, the firmware is configured to map a design to be printed onto the printable surface mapped by the scanner.

Ideally, the firmware is configured to instruct the printer to print a design to be printed onto the printable surface mapped by the scanner.

Ideally, the electronic device comprising a computing device.

Preferably, the computing device having a Central Processing Unit (CPU).

Ideally, the computing device having memory storage means.

Preferably, the memory storage means comprising Read Only Memory (ROM) and/or Random Access Memory (RAM).

Ideally, the computing device comprising but not limited to a desktop/mobile computing device.

Preferably, the electronic device having an operating system installed.

Ideally, the electronic device having nail art application software installed for operable engagement with the printing apparatus.

Preferably, the nail art application software is storable on the memory means of the electronic device and is executable therefrom.

Preferably, the nail art application software having means for operable engagement with the printing apparatus.

Ideally, the nail art application software being operable to transmit commands to the printing apparatus via the microcontroller and/or USB.

Preferably, the printing apparatus and electronic device are connectable to the microcontroller.

Ideally, the electronic device and the printing apparatus are connectable via USB.

Preferably, the electronic device is connectable to a Visual Display Unit (VDU).

Ideally, the VDU comprising but not limited to a monitor/television.

Ideally, the VDU having means for displaying a Graphical User Interface (GUI).

Preferably, the GUI being graphical and/or text based.

Ideally, the VDU having means for displaying the application software from the electronic device.

Preferably, the printing apparatus being operably coupled to the electronic device to allow for user interaction.

Ideally, the electronic device having interface means for user operation.

Preferably, the interface means comprising touch screen operating means.

Preferably, the VDU of the electronic device having touch screen operating means.

Ideally, the electronic device being operable to process commands received via the touch screen operating means of the VDU.

Ideally, the touch screen operating means having capacitive or resistive touch screen operating means.

Preferably, the touch screen operating means having a projected capacitive touch screen.

Ideally, the projected touch screen operating means comprising an outer layer of dielectric material layered on a projected capacitive touch screen layered on a monitor display.

Preferably, the projected touch screen operating means comprising an outer layer of dielectric material layered on a layer of transparent conductive material layered on a layer of transparent separating material layered on a layer of transparent conductive material layered on an electronic device display.

Ideally, the plurality of transparent conductive layers comprising a matrix of rows and columns of conductive material.

Preferably, the plurality of transparent conductive layers having a voltage applied to them creating a uniform electrostatic field.

Ideally, the plurality of transparent conductive layers having a uniform electrostatic field which is measureable.

Preferably, the touch screen operating means being operably able to detect the proximity of a body part due to the change in the electrostatic field and resulting capacitance across the plurality of transparent conductive layers.

Alternatively, the interface means comprising a connectable peripheral interface means.

Ideally, the peripheral interface means comprising but not limited to a mouse/keyboard/joystick/gamepad.

Preferably, the peripheral interface means being connectable via wire.

Ideally, the peripheral interface means being connectable via radio technology.

Preferably, the radio technology comprising but not limited to low power radio frequency and/or Wi-Fi.

Alternatively, the interface means comprising voice recognition means.

Ideally, the electronic device being connectable to a microphone.

Preferably, the electronic device being connectable to at least one speaker.

Ideally, the enclosure having a plurality of speakers.

Preferably, the electronic device being operably able to relay audible on-screen instructions using the speakers.

Ideally, the electronic device having Text To Speech (TTS) software.

Preferably, the electronic device having speech recognition software.

Ideally, the microphone being operable to receive a plurality of commands.

Preferably, the plurality of commands corresponding to a plurality of functions on the electronic device.

Ideally, the plurality of functions on the electronic device comprising but not limited to nail art selection/payment choice/language selection.

Preferably, the microphone being operable to relay a plurality of commands to the electronic device.

Ideally, the electronic device having means for processing the audible commands.

Preferably, the electronic device having speech recognition software installed.

Ideally, the electronic device having a software application installed for interaction with the printing apparatus.

Preferably, the user being operably able to interact with the software application using the interface means.

Ideally, the interface means allowing for the selection of the quantity of nails to be printed on or upon.

Preferably, the interface means being capable of switching between a setting for artificial and natural nails.

Preferably, the enclosure having payment receiving means.

Ideally, the payment receiving means being connectable to the electronic device.

Ideally, the payment receiving means comprising slots for the intake of coins and/or cash.

Preferably, the payment receiving means further comprising a card payment receiving means.

Ideally, the card payment receiving means being a magnetic card reader.

Preferably, the magnetic card reader being operable to receive credit/debit/gift/store cards.

Preferably, the card payment receiving means being operable to utilise Near Field Communication (NFC) payments.

Ideally, the enclosure having means for receiving coins/cash and card payment means.

Alternatively, the payment receiving means comprising biometric identification means.

Ideally, the biometric identification means comprising a fingerprint scanner.

Ideally, the electronic device having a nail art design library.

Preferably, the electronic device containing a library of a plurality of shapes/patterns/colours/designs of nail art.

Ideally, the interface means providing menu means to allow the user to select their design from the nail art design library.

Preferably, the touch screen operating means allowing the user to interact with the nail art design library.

Ideally, the nail printing apparatus has a camera device for capturing images which may be used for printing.

Ideally, the enclosure having the camera device.

Preferably, the camera device comprising but not limited to a webcam/digital camera.

Ideally, the electronic device being operable to utilise the images captured using the camera device for selection by the user for printing.

Preferably, the apparatus being operable to capture an image using the camera device via the interface means.

Ideally, the camera device having an illumination means.

Preferably, the illumination means comprising a flash unit.

Preferably, the electronic device has one or more means for receiving a portable storage device.

Ideally, the portable storage device being connectable to the electronic device and/or printing apparatus.

Ideally, the electronic device or printing apparatus having a plurality of USB ports.

Preferably, the electronic device or printing apparatus having at least one SD card port.

Ideally, the portable storage device comprising but not limited to a USB flash drive/SD card/portable HDD/SSD/Smartphone.

Ideally, the electronic device or printing apparatus has a one or more ports for receiving one or any combination of a USB flash drive, SD card, portable HDD/SSD, and/or Smartphone.

Preferably, the portable storage device having means for transferring images to the electronic device for use with the nail art printing software.

In an alternative embodiment, the electronic device is connectable to the internet.

Ideally, the electronic device is connectable to the internet using a router.

Preferably, the electronic device having means for downloading a plurality of images for use with the nail art printing software.

Ideally, the electronic device having an associated mobile device application.

Preferably, the user having a mobile device.

Ideally, the mobile device comprising a smartphone.

Preferably, the mobile device having the associated mobile device application installed.

Ideally, the mobile device application having means for pre-purchasing nail art treatment.

Preferably, the mobile device having means for obtaining a unique code from the associated mobile device application for entry into the electronic device.

Ideally, the mobile device obtaining a QR code from the associated mobile device application.

Preferably, the connectable camera unit to the electronic device in the enclosure being operable to scan the QR code on the mobile device.

Ideally, the receiving means having means for receiving a body part.

Preferably, the body part is a finger or plurality of fingers.

Ideally, the finger or plurality of fingers having natural and/or artificial nails.

Preferably, the receiving means being capable of receiving one or more unattached artificial nails.

Ideally, the receiving means comprising a recess in the enclosure.

Preferably, the recess in the enclosure having a receiving device.

Preferably, the receiving device being capable of receiving a finger or plurality of fingers or one or a plurality of unattached artificial nails.

Ideally, the receiving device comprising but not limited to a tray/container/receptacle/board/mould/paddle.

Ideally, the nail art printing apparatus has a safety means for ensuring that a finger or plurality of fingers placed into the receiving device do not risk injury from any mechanisms or electronics of the nail art printing apparatus.

Preferably, the safety means comprises the structure of the receiving device and/or associated structure of the enclosure being designed such that a user is prevented from placing one or more fingers in an area where proximity to moving parts or electronics would result in risk of injury.

Ideally, the safety means comprises at least one resistance sensor configured to detect any resistance to the movement of one or more moving components of the nail art printing apparatus over and above the normal resistance encountered by the components.

Preferably, the one or each resistance sensor is in operable engagement with an actuator associated with the moving component for which it is configured to detect any resistance to the movement thereof.

Ideally, the resistance sensor is in operable communication with the electronic device.

Preferably, the safety means comprises means for reversing the movement of a movable component encountering resistance.

Ideally, should the one or more resistance sensors detect resistance to movement of an associated moving component, the actuator of the respective moving component will effect reverse movement in a direction opposite to that which experienced resistance.

Preferably, a safety software control program is storable on the memory means of the electronic device and executable thereform, the safety software control program configured to receive an output from the resistance sensor reflective of the level of resistance to movement or the resistance force encountered by a moving component.

Ideally, the safety software control program has a reference value programmed therein reflective of a level of resistance to movement or a resistance force encountered which equates to unimpeded movement of a moving component.

Preferably, the safety software control program is configured to compare the reference value to the output of the resistance sensor.

Ideally, where the output of the resistance sensor is reflective of a level of resistance to movement or a resistance force higher than the reference value, the software control program will instruct an actuator associated with the moving component to stop movement and/or effect movement in a direction opposite to that which experienced resistance.

Preferably, the output resistance sensor is a mechanical type force sensor comprising a compressible strut.

Ideally, the compressible strut locatable such that the axial direction of the compressible strut is in the direction of motion of the movable component on the movable component or a component effecting movement thereof, such that as the movable component moves, the compressible strut will be compressed to a varying degree depending on the resistance to movement.

Ideally, the level of compression of the compressible strut forms the output of the resistance sensor.

Preferably, the level of compression of the compressible strut is defined by the linear distance moved by the compressible portion of the compressible strut.

Preferably, the resistance sensor comprises means for determining the time taken for a predefined portion of the movable component or component effecting movement thereof to travel to a pre-specified position.

Ideally, the means for determining the position comprises one component mounted at a predefined portion of the movable component or component effecting movement thereof.

Preferably, the means for determining the position comprises a second component locatable on a fixed portion of the nail art printing apparatus at pre-specified positions.

Preferably, the safety software control program has time reference values programmed thereinto relating to the time taken for the predefined portion of the movable component to travel to each pre-specified location.

Ideally, the time reference values relate to the expected time the pre-defined portion of the movable component should reach a pre-specified location should it be unimpeded.

Ideally, where the determined time for the predefined portion of the movable component to reach a pre-specified location differs from the time reference value for the relevant pre-specified position, the software control program will instruct an actuator associated with the moving component to stop movement and/or effect movement in a direction opposite to that which experienced resistance.

Preferably, the safety means comprises one or more physical restraints such that a user is encouraged to place their one or more fingers in a specific location.

Ideally, the one or more physical restraints comprise a generally fingertip shaped enclosure.

Preferably, the one or more physical restraints comprise an aperture alignable with a nail of a finger such that the printer can print onto the nail trough the aperture.

Preferably, the safety means comprises an object detection means for detecting the location of objects in the nail printing area.

Ideally, the safety means comprises an object detection means for detecting the correct presence of the fingernail and/or detecting any objects in areas where movement of any nail art printing apparatus components may cause injury.

Preferably, the object detection means is a visual based sensor.

Ideally, the object detection means is a camera.

Preferably, the object detection means has an associated software control program storable on the memory means of the electronic device, and executable thereform, which is configured to process the data from the object detection means to determine whether it is safe to print.

Preferably, the object detection means is operably coupled to the motion actuator if the printing head or the receiving means for preventing movement of actuators or printing when unsafe objects are detected.

Ideally, the object detection means is operably coupled to the actuator of the movable component.

Preferably, the scanning means of the printing apparatus being operable for locating the user's one or more fingers or nails or the one or more unattached artificial nails.

Ideally, the nail art printing apparatus being operable to apply the user's chosen design to their one or more nails.

Preferably, the user's nails comprising one or more natural or artificial nails.

Ideally, the nail art printing apparatus being operable for printing on one or more unattached artificial nails positioned in the receiving means.

In an alternative embodiment, the nail art printing apparatus having means for attaching one or more artificial nails to a body part.

Ideally, the nail art printing apparatus having heating means for drying the applied nail art.

Preferably, the enclosure having heating means for drying the applied nail art.

Ideally, the heating means comprising a UV source and/or forced convection means.

Ideally, the nail art printing apparatus connectable to a UV source.

Preferably, the UV source comprising a UV lamp.

Ideally, the UV source being operable to dry the applied nail art.

Ideally, the nail art printing apparatus being connectable to a forced convection means.

Preferably, the forced convection means comprising a fan.

Ideally, the enclosure having ventilation and/or cooling means.

Preferably, the ventilation means comprising but not limited to a plurality of ventilation holes.

Ideally, the cooling means comprising at least one fan.

Preferably, the enclosure having a base plate.

Ideally, the base plate comprising at least one sheet of material.

Preferably, the sheet of material comprising but not limited to steel/iron/plastic.

Preferably, the enclosure having fixing means for attachment to a support surface.

Ideally, the fixing means comprising one or more bolts.

Preferably, the fixing means attaching the base plate to the support surface.

Ideally, the enclosure comprises a front cover and a back cover connectable together.

Preferably, the front and back cover sandwiching the electronic device and nail art printing apparatus.

Ideally, the front panel of the box having a plurality of apertures.

Preferably, at least one aperture aligning with the VDU of the electronic device.

Ideally, the front panel of the enclosure having a least one aperture alignable with at least one speaker.

Preferably, the front panel of the enclosure having at least one aperture for housing the camera device and flash unit.

Ideally, the front panel of the enclosure having a recessed portion.

Preferably, the recessed portion comprising an open fronted box.

Ideally, the payment receiving means being accessible in the recessed portion.

Preferably, the body part receiving means being accessible in the recessed portion.

Ideally, the printing apparatus being housed in the enclosure alignable with the aperture for the body part receiving means.

Preferably, the back panel of the enclosure having a plurality of ventilation holes.

Ideally, the back panel of the enclosure having at least one access means.

Preferably, the access means comprising at least one section of material pivotable about at least one point which is flush with the back panel when closed.

Ideally, the pivotable point comprising at least one hinge.

Ideally, the access means providing access to the electronic device, printing apparatus and payment receiving means.

Preferably, the access means having a locking means.

Ideally, the locking means comprising a mechanical or electronic fastening device.

Preferably, the front panel having three longitudinal walls extending from about or proximal to the base plate.

Ideally, the back panel having three longitudinal walls extending from about or proximal to the base plate.

Preferably, the longitudinal walls having a c shaped cross section.

Preferably, the front panel of the enclosure extending from the base at an inclined angle before extending in the same general direction but at an opposite angle.

Ideally, the back panel of the enclosure extending from the base at an inclined angle before extending in a different direction at a different angle.

Preferably, the front and back panel being connectable.

Ideally, the connecting means comprising a plurality of bolts.

Preferably, the front and back panel having waterproof sealing.

The invention will now be described with reference to the accompanying drawing which shows by way of example only one embodiment of a nail art printing apparatus in accordance with the invention. In the drawings.

Figure 1:
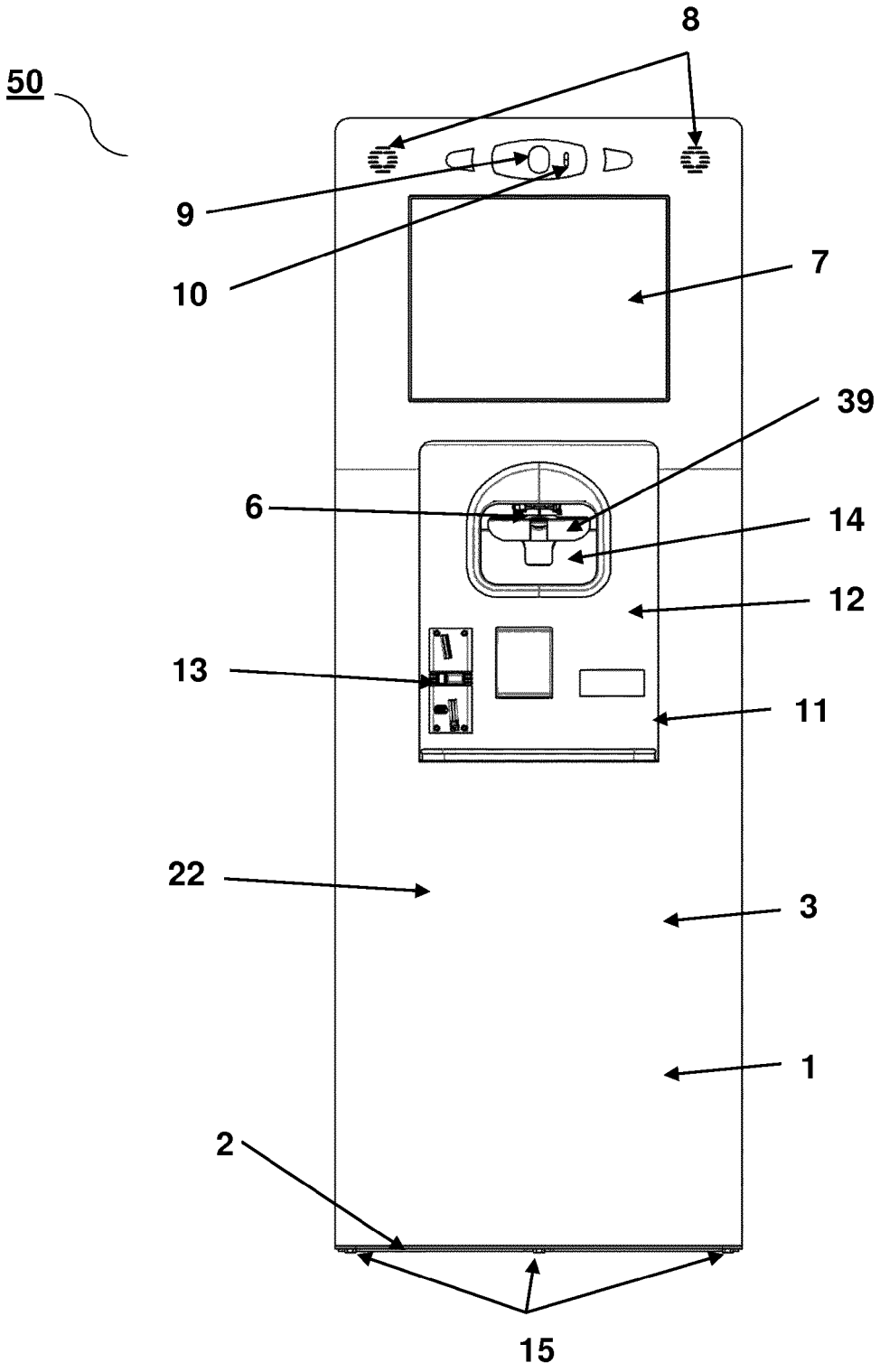
FIG. 1 is a front view of the nail art printing apparatus showing the front of the enclosure.
Figure 2:
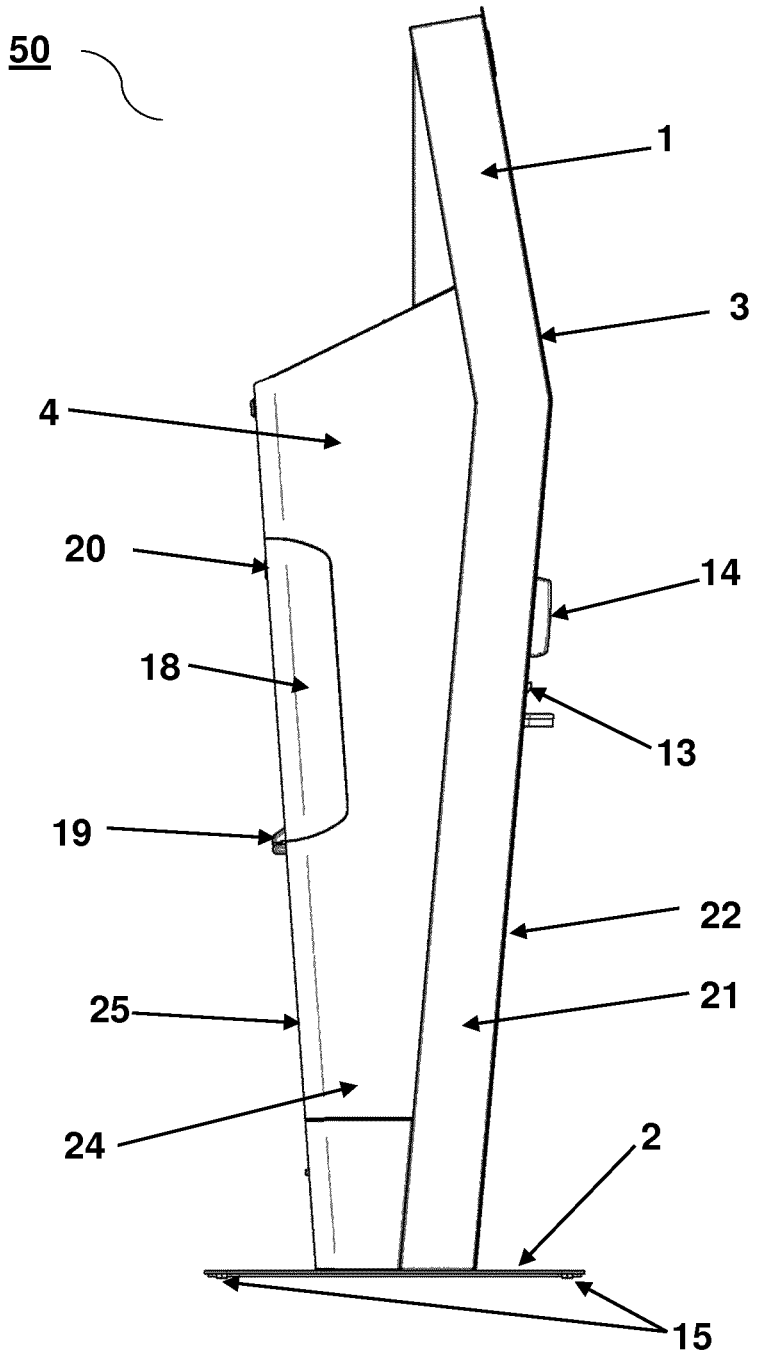
FIG. 2 is a side view of the nail art printing apparatus showing the front and back panel in assembled configuration.
Figure 3:
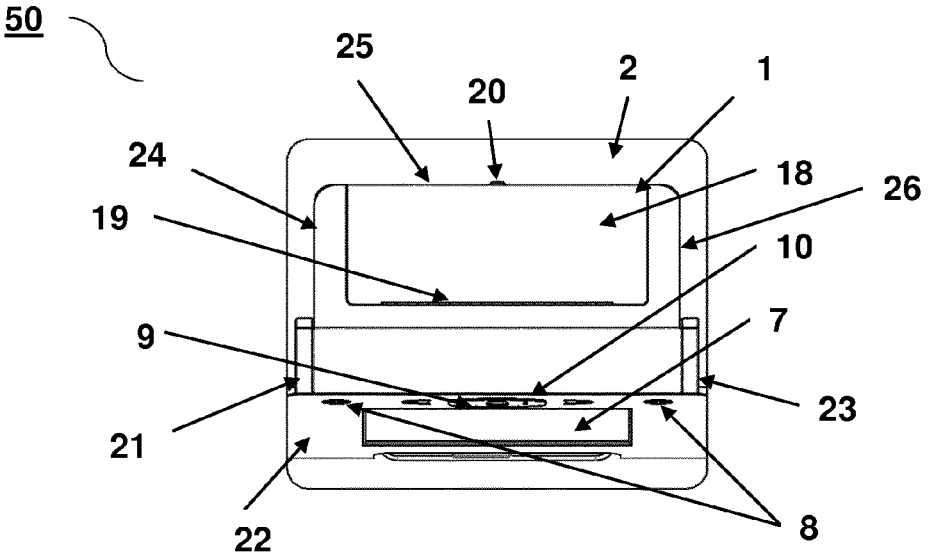
FIG. 3 is a top/bottom plan view of the enclosure.

Referring to the drawings and initially to FIGS. 1 to 5, there is shown a nail art printing apparatus generally indicated by the reference numeral 50 having an enclosure 1 and also having a base plate 2 manufactured from at least one sheet of material. The base plate being made of metal/plastic or a similar suitable rigid base plate. The enclosure 1 has a fixing apparatus 15 see especially FIGS. 1 and 2 for attachment to a support surface, the fixing apparatus 15 being a number of bolts which attach the base plate 2 to the support surface. The enclosure 1 has a front panel 3 and a back panel 4 see especially FIGS. 2, 4 and 5 which connect together, sandwiching the electronic device 5 and printing apparatus 6.

The front panel 3 of the enclosure 1 see especially FIG. 1 has a plurality of apertures with at least one aperture aligning with the VDU 7 of the electronic device 5. It also has at least one aperture which is aligned with at least one speaker 8 as well as at least one aperture which houses the camera device 9 and flash unit 10. The front panel 3 of the enclosure 1 has a recessed portion 11 which is an open fronted box 12 which provides access to the payment receiving arrangement 13 and body part receiving arrangement 14. The printing apparatus 6 housed in the enclosure 1 aligns with the aperture for the body part receiving arrangement 14.

Figure 5:
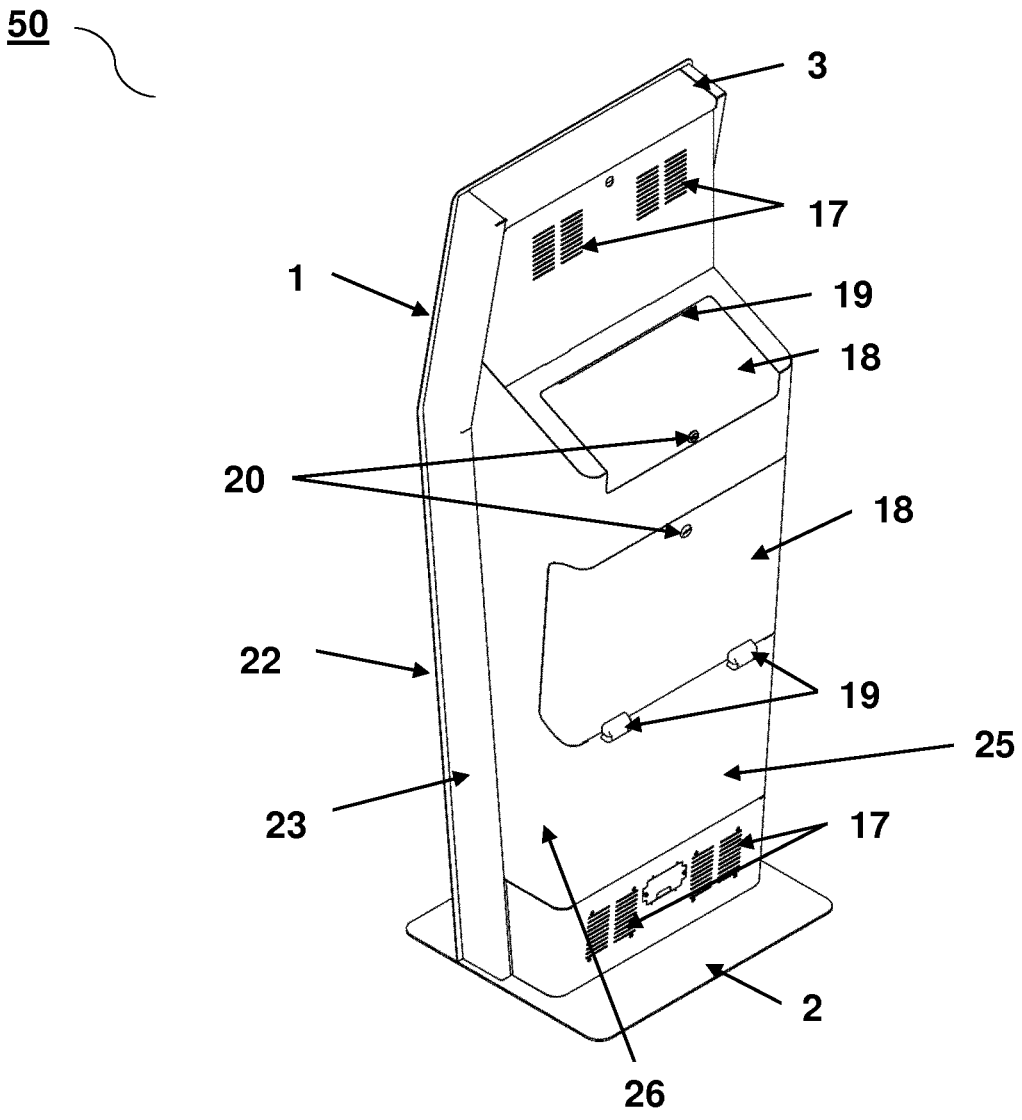
FIG. 5 is a perspective view of the nail art printing apparatus showing the back panel of the enclosure.

The back panel 4 of the enclosure 1 has a plurality of ventilation holes 17 and access panels 18 see especially FIG. 5. The access panels 18 are sections of material which pivot about one or more hinges 19 and are flush with the back panel 4 when closed. The access panels 18 provides access to the electronic device 5, printing apparatus 6 and the payment receiving arrangement 13. The access panels 18 have a locking arrangement 20 which is either a mechanical or electronic fastening device.

Figure 4:
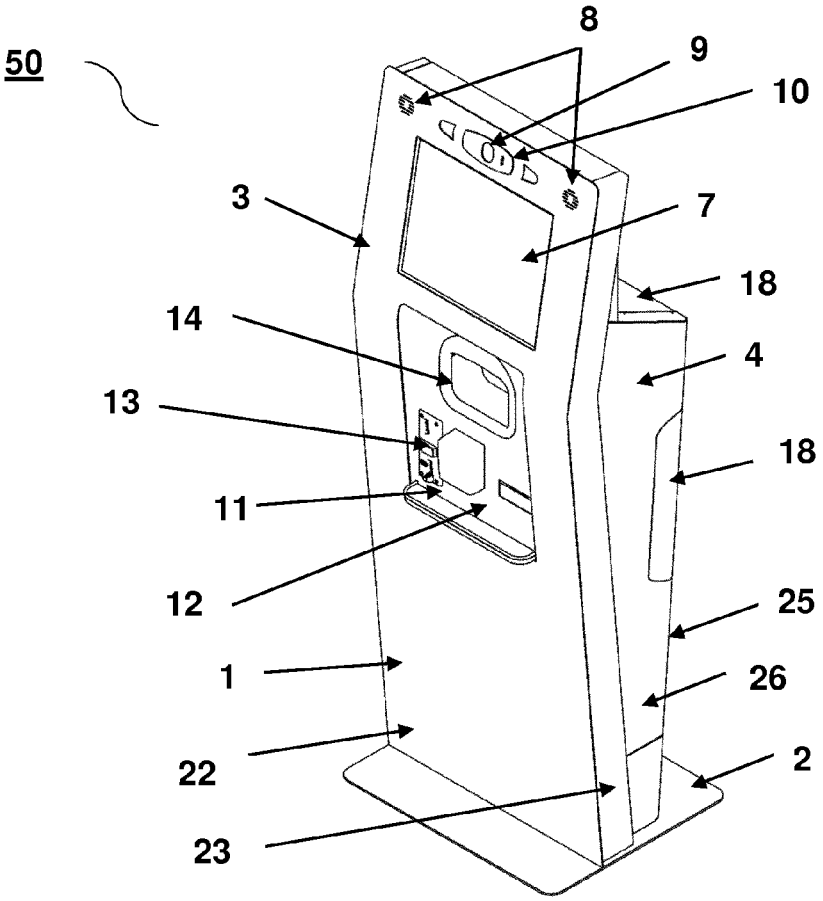
FIG. 4 is a perspective view of the nail art printing apparatus showing the front and back panel of the enclosure in assembled configuration.

The front panel 3 has three longitudinal walls 21, 22 and 23 which extend from about or proximal to the base plate 2 see especially FIGS. 4 and 5. The front panel 3 of the enclosure 1 extends from the base plate 2 at an inclined angle before extending in the same general direction but at an opposite angle see especially FIGS. 2, 4 and 5. The back panel 4 also has three longitudinal walls 24, 25 and 26 which extend from about or proximal to the base plate see especially FIGS. 4 and 5. The plurality of longitudinal walls have a C shaped cross section. The back panel 4 of the enclosure 1 extends from the base plate 2 at an inclined angle before extending in a different direction at a different angle again see especially FIGS. 2, 4 and 5.

Figure 6:
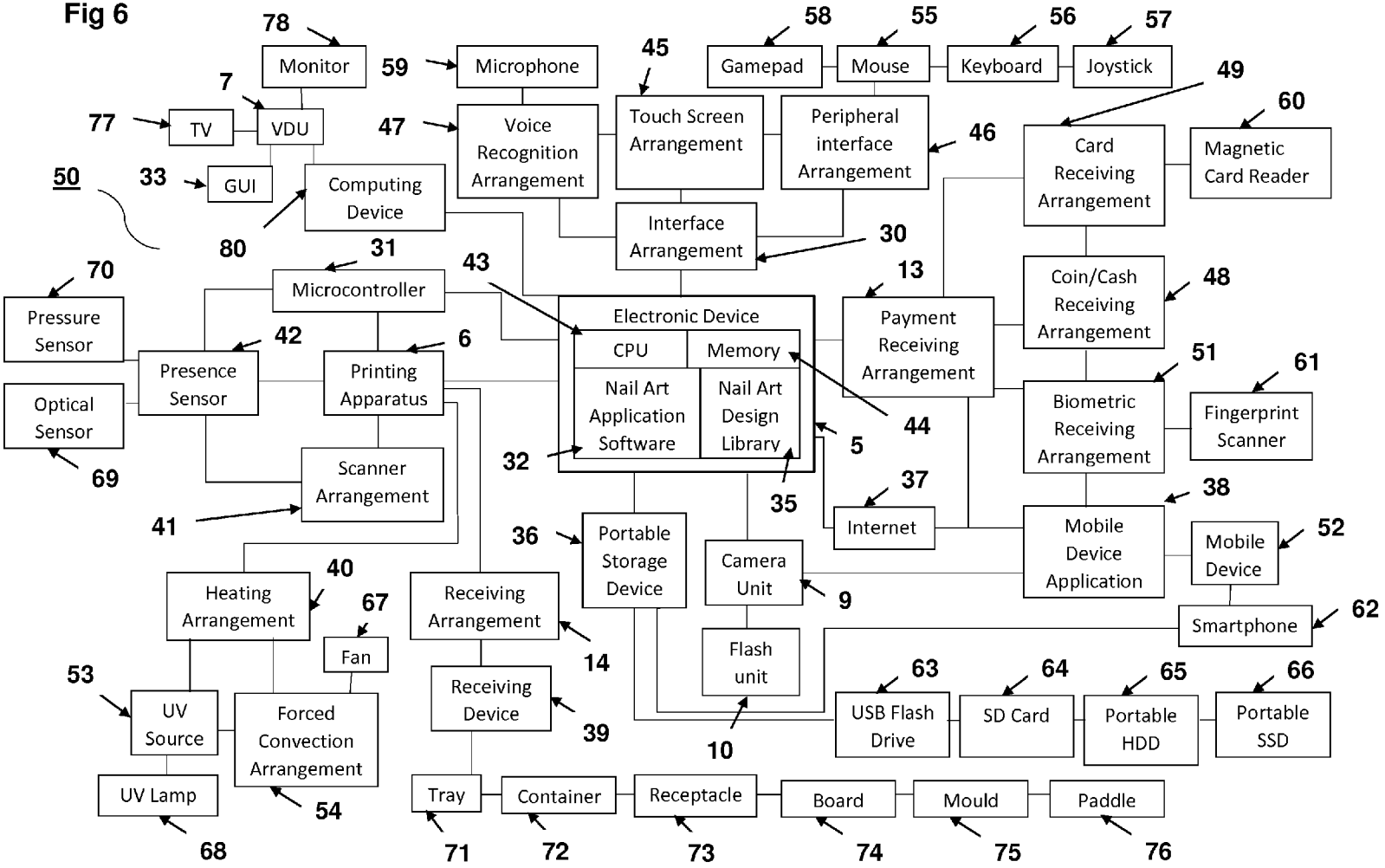
FIG. 6 is a schematic view of the overall nail art printing apparatus architecture.

Referring to the drawings and in particular FIG. 6 there is shown a schematic of the architecture of a nail art printing apparatus 50 which has a receiving arrangement 14 for the placement of a body part or nail or plurality of nails. The printing apparatus 6 is connected to an electronic device 5 which provides an interface arrangement 30 which allows for operable engagement between the electronic device and the printing apparatus 6. The nail art printing apparatus 50 is able to apply a plurality of colours and/or designs to nails, with the added advantage that the one or more nails can be natural of artificial.

In a preferred embodiment the nail art printing apparatus 50 is a printing apparatus 6 and electronic device 5 housed in an enclosure 1 which is free standing. The printing apparatus 6 is a printer and more specifically an inkjet printer. The printer is of multi-headed design and has a scanner arrangement 41 which is able to scan nails located in the receiving arrangement 14 for accurate application of the nail art. The printer 6 has a presence sensor 42 for detecting the presence of nails which is either a pressure sensor 70 or optical sensor 69 whose output is coupled to firmware. The firmware is installed on a microcontroller 31 which is also connected to the printer 6 and the presence sensor 42 itself. The printer 6 is able to print onto one or more natural and/or artificial nails under the control of the microcontroller upon the detection of the presence of fingers/nails via the presence sensor 42. The microcontroller 31 is also connected to the electronic device 5 which is typically a computing device 80 which has a Central Processing Unit (CPU) 43 and a memory storage arrangement 44 such as Read Only Memory (ROM) and/or Random Access Memory (RAM).

The computing device 80 is a desktop/mobile computing device which has an operating system installed. Furthermore the electronic device 5 has nail art application software 32 installed for operable engagement with the printing apparatus 6. The electronic device 5 is connected to the printing apparatus 6 via USB and this allows the nail art application software 32 to transmit commands to the printing apparatus 6 via the microcontroller 31 and/or USB connection.

The electronic device 5 is connected to a Visual Display Unit (VDU) 7 which is either a monitor 77 or a television 78 which displays a Graphical User Interface (GUI) 33 being either graphical and/or text based. The VDU 7 displays the nail art application software 32 from the computing device 5. Interaction between the user and the printing apparatus 6 is achieved via the electronic device 5 which has an interface arrangement 30 which in a preferred embodiment is a touch screen arrangement 45 using the VDU 7 with the electronic device 5 processing the commands received via the touch screen operating arrangement 45 of the VDU 7 see especially FIG. 6.

The touch screen operating arrangement 45 is achieved using either a capacitive or resistive touch screen with a projected capacitive being preferred. This is made up of an outer layer of dielectric material layered on a layer of transparent conductive material layered on a layer of transparent separating material layered on a layer of transparent conductive material layered on the electronic devices' 5 VDU 7. The plurality of transparent conductive layers comprise a matrix of rows and columns of conductive material which have a voltage applied to them which creates a uniform electrostatic field which is measurable. The touch screen operating arrangement 30 is then able to detect the proximity of a body part due to the change in the electrostatic field and resulting capacitance across the plurality of transparent conductive layers.

In an alternative embodiment, the interface arrangement 30 consists of a connected peripheral interface arrangement 46 such as a mouse 55/keyboard 56/joystick 57/gamepad 58 which are connected via wire or wireless using radio technology such as low power radio frequency and/or Wi-Fi.

In a further alternative embodiment, the interface arrangement 30 is a voice recognition arrangement 47 with the electronic device 5 having a microphone 59 and a number of speakers 8 connected. The electronic device 5 is able to relay audible on-screen instructions using the speakers as it has Text To Speech software (TTS). Furthermore the user is also able to voice commands using the microphone 59 and the electronic device 5 having speech recognition software installed which is able to receive a plurality of voiced commands. The voiced commands corresponding to a plurality of functions on the electronic device 5 such as nail art selection/payment choice/language selection.

The user is able to interact with the nail art software application 32 using the interface arrangement 30 which allows the user to select how many artificial nails the user wants printed or how many natural nails the user wants nail art printed upon. The interface arrangement 30 allows the user to select between settings for artificial and natural nails. The enclosure 1 has a payment receiving arrangement 13 which is connected to the electronic device 5. The payment receiving arrangement 13 consists of a coin/cash receiving arrangement 48 comprising slots for the intake of coins and/or cash as well as a card payment receiving arrangement 49 such as a magnetic card reader 60 which is able to receive credit/debit/gift/store cards. The magnetic card reader may also receive Near Field Communication (NFC) payments.

In an alternative embodiment the payment receiving arrangement 13 consists of a biometric identification arrangement 51 which is a fingerprint scanner 61.

The electronic device 5 has a nail art design library 35 which contains plurality of shapes/patterns/colours/designs of nail art. The user selects their design from the nail art design library 35 using the interface means 30 before printing. The enclosure 1 also has a camera device 9 such as a webcam or digital camera with a flash unit 10 for illumination connected which allows the apparatus to capture an image using the interface arrangement 30 for use with printing. The electronic device 5 can also receive more images for printing from a portable storage device 36 such as a USB flash drive 63/SD card 64/portable HDD 65/SSD 66/Smartphone 62. The portable storage device 36 can be connected to the electronic device 5 and/or the printing apparatus 6 as both will have a number of USB and/or SD ports.

In an alternative embodiment, the electronic device 5 is connected to the internet 37 using a router which allows a user to download a plurality of images for use with the nail art printing software. Also the electronic device 5 with nail art application software 32 will have an associated mobile device application 38. The user will have a mobile device 52 such as a smartphone 62 with the associated mobile device application 38 installed, this will allow the user to pre-purchase a nail art treatment using the associated mobile device application 38. The mobile device application 38 will allow the user to obtain a unique code upon receiving payment for entry into the electronic device 5. This unique code is a serial number or a QR code which can be scanned using the camera unit 9 of the enclosure 1.

The receiving arrangement 14 allows the enclosure 1 to receive a body part such as a finger or plurality of fingers as well as being able to receive a plurality of unattached artificial nails. The receiving arrangement 14 consists of a receiving device 39 being a tray 71/container 72/receptacle 73/board 74/mould 75/paddle 76. Once a user has paid, selected their chosen design they then place their nail(s) into the receiving arrangement 14 upon which the scanner arrangement 41 of the printing apparatus 6 is able to locate the user's finger(s) or nail(s) and the nail art printing apparatus 50 applies the user's chosen design to their nail(s), with the nails being either natural or artificial. Furthermore the user is able to place sets of unattached artificial nails into the receiving arrangement 14 for printing.

In an alternative embodiment, the nail art printing apparatus 50 is able to attach artificial nails to a user's fingers before the application of nail art.

The printing apparatus 6 or the enclosure 1 has a heating arrangement 40 for drying the applied nail art. The heating arrangement 40 consists of a UV source 53 such as a UV lamp 68 or a forced convection arrangement 54 such as a fan 67 or a combination of the two. The heating arrangement 40 is connected to the nail art printing apparatus 6. The enclosure 1 also has a ventilation and/or cooling arrangement such as a plurality of ventilation holes 8 or a fan.

Figure 7:
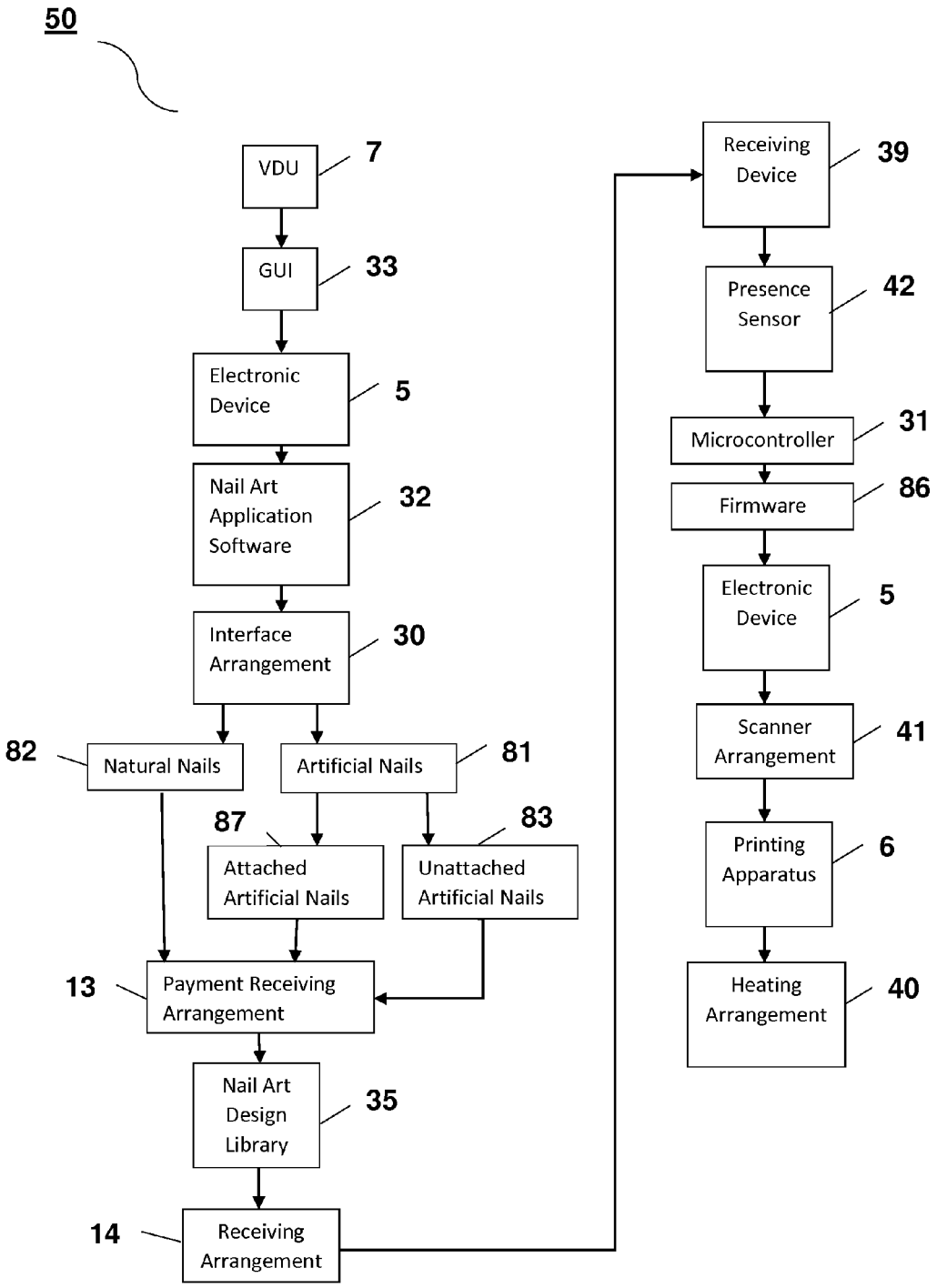
FIG. 7 is a schematic diagram of the nail art printing apparatus in use.
Figure 8:
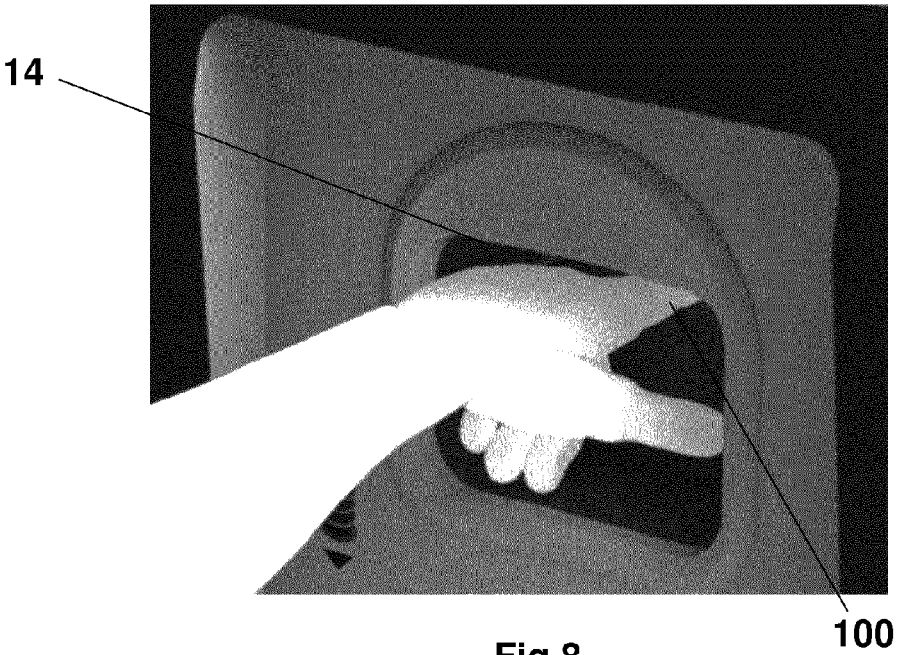
FIG. 8 is a perspective view of a portion of the nail art printing apparatus showing user placing a finger into the nail art printing apparatus.
Figure 9:
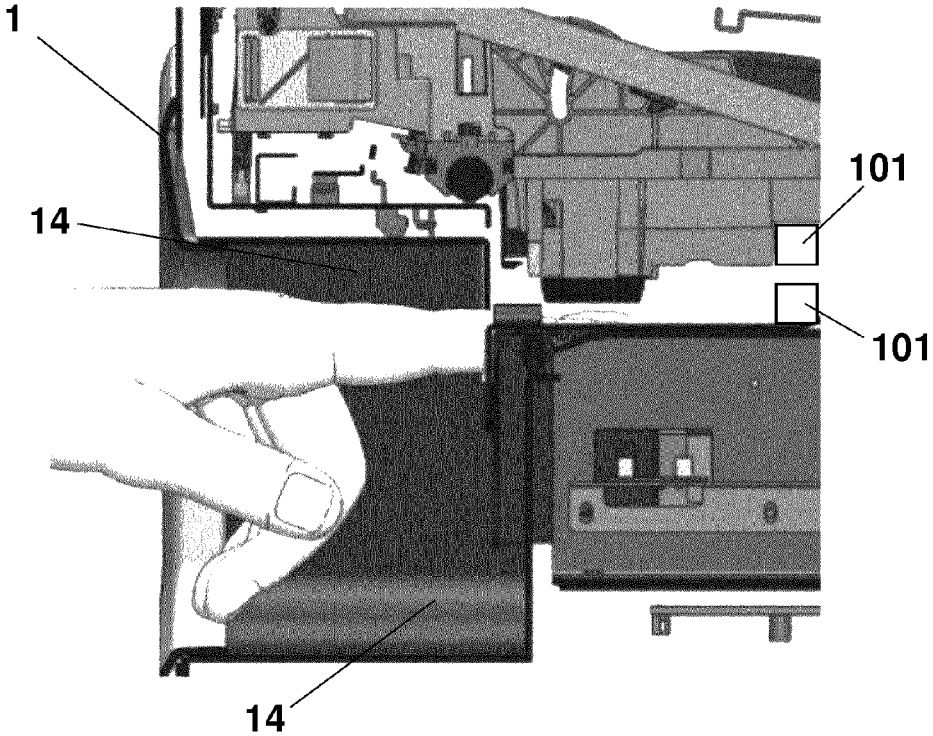
FIG. 9 is a sectional view of a portion of the nail art printing apparatus showing a user placing a finger into the nail art printing apparatus.

In use, and referring to FIGS. 6 and 7 a person will approach the enclosure 1 and the VDU 7 will display a GUI 33 corresponding to the nail art application software 32 installed on the electronic device 5. The user will engage with the nail art printing apparatus 50 by interacting via the interface arrangement 30 which can be a touch screen arrangement 45 or a voice recognition arrangement 47 or a peripheral interface arrangement 46. In use, the user will select using one of these interface arrangements 30 whether they want nail art printed on artificial nails 81 or natural nails 82.

If natural nails 82 are chosen to be printed upon the user will then select what quantity of natural nails are to be applied with nail art. If artificial nails 81 are chosen the user will be asked whether they want nail art to be printed on artificial nails already attached 87 to the user's fingers or on a set of unattached artificial nails 83, after which they will then be asked what quantity of nails are to be printed upon. In both cases the user will then be instructed to pay a required amount using the payment receiving arrangement 13 which can be done using a coin/cash receiving arrangement 48 or a card receiving arrangement 49 or a biometric receiving arrangement 51. Alternatively the user can use a mobile device 52 such as a smartphone 62 with a mobile device application 38 to purchase a nail art treatment using a credit/debit card and upon the completion of which they will obtain a serial code for entry into the nail art apparatus or a QR code which will be scannable using the camera unit 9 of the nail art printing apparatus 50.

Once payment is received the user will then select a design they want to be applied to their nail(s) from the nail art design library 35 which contains a plurality of shapes/patterns/colours/designs of nail art, or alternatively they will insert a portable storage device 36 or use the camera unit 9 of the apparatus or use the internet to obtain a further selection of images for printing. Once the user has selected their design they will then be instructed to insert their finger(s) or artificial nail(s) into the receiving arrangement 14 for printing. The user will place their finger(s) or unattached artificial nail(s) 83 into/onto a receiving device 39 such as a tray 71/container 72/receptacle 73/board 74/mould 75/paddle 76. When the user does this a presence sensor 42 in the printing apparatus 6 will detect the insertion. This presence sensor 42 is connected to a microcontroller 31 which has firmware 86 installed which is able to transmit this insertion confirmation to the printing apparatus 6 and the electronic device 5 upon which the scanner arrangement 41 will scan the fingers of the user or the unattached artificial nails 83 to obtain the nail location and the printing apparatus 6 will apply a primer. After this is complete the heating arrangement 40 being either a UV source 53 such as a UV lamp 68 or a forced convection arrangement 54 such as a fan 67 will dry the primer. Once this is complete the user will be requested to start their nail design printing and the printing apparatus 6 will apply their chosen nail art design, after which the heating arrangement 40 will dry the users applied nail art and the user will be instructed to remove their finger(s) or artificial nail(s) 81 from the receiving arrangement 14.

FIGS. 8 to 11 illustrate the safety elements of the nail art apparatus 50 for ensuring that a finger 100 or plurality of fingers placed into the receiving device do not risk injury from any mechanisms or electronics of the nail art printing apparatus 50. The safety elements comprise the structure of the receiving arrangement 14 and/or associated structure of the enclosure 1 being designed such that a user is prevented from placing one or more fingers 100 in an area where proximity to moving parts or electronics would result in risk of injury. At least one resistance sensor 101 is configured to detect any resistance to the movement of one or more moving components of the nail art printing apparatus. Should the resistance sensor 101 detect resistance to movement of an associated moving component, the actuator of the respective moving component will effect reverse movement in a direction opposite to that which experienced resistance. A safety software control program 110 is storable on the memory 44 of the electronic device 5 and executable thereform (see FIG. 12). The safety software control program is configured to receive an output from the resistance sensor 101 reflective of the level of resistance to movement or the resistance force encountered by the moving component 111. The safety software control program 110 has a reference value programmed therein reflective of a level of resistance to movement or a resistance force encountered which equates to unimpeded movement of a moving component 111 and is configured to compare the reference value to the output of the resistance sensor 101. Where the output of the resistance sensor 101 is reflective of a level of resistance to movement or a resistance force higher than the reference value, the software control program 110 will instruct an actuator 112 associated with the moving component 111 to stop movement and/or effect movement in a direction opposite to that which experienced resistance.

Figure 10:
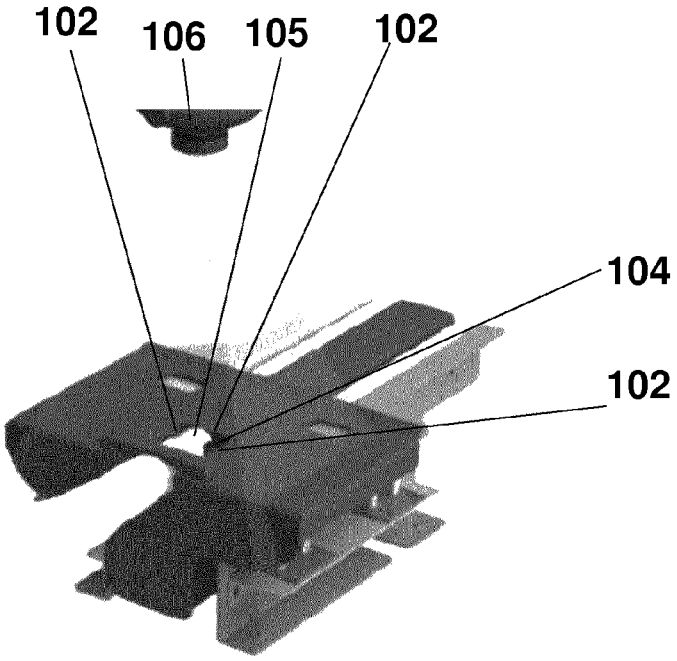
FIG. 10 is a perspective view of the receiving device showing the object detection camera.
Figure 11:
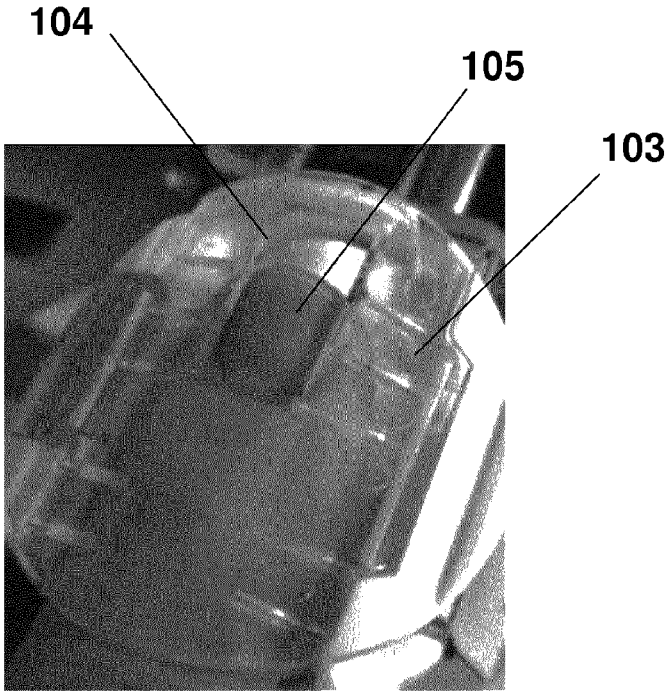
FIG. 11 is a perspective view of the physical restraint showing the aperture therein.
Figure 12:
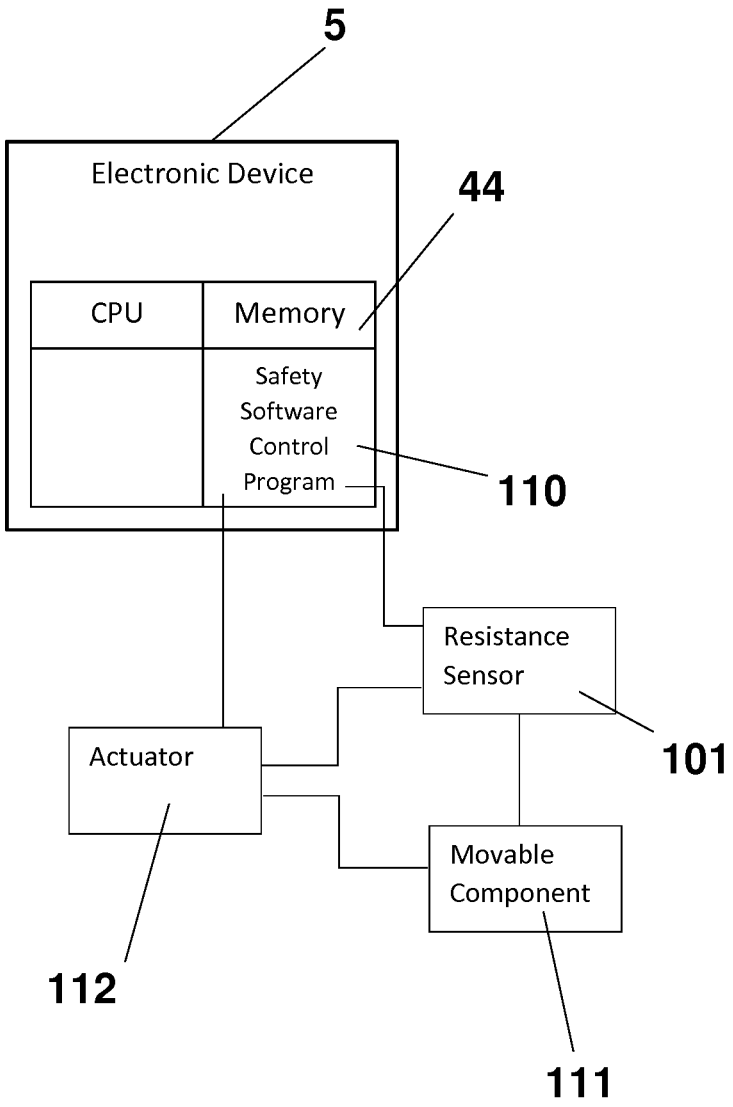
FIG. 12 is a schematic view of the resistance sensor and supporting architecture.
Figure 13:
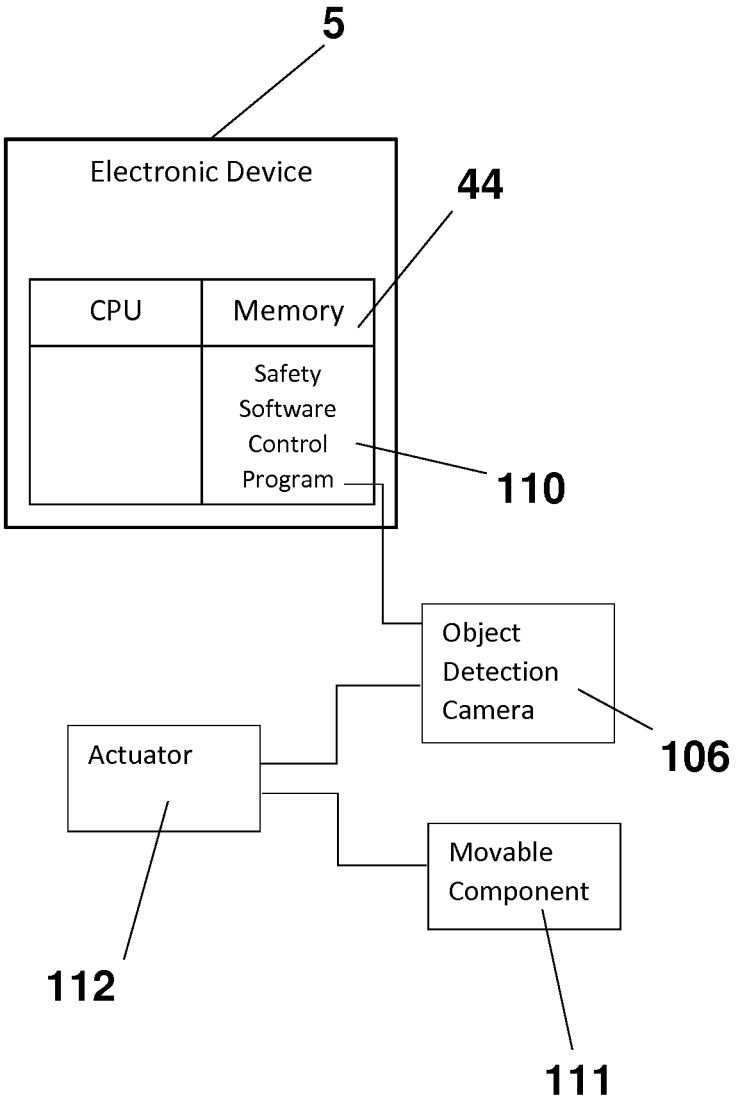
FIG. 13 is a schematic view of the resistance sensor and supporting architecture.

The safety elements further comprise one or more physical restraints 102 such that a user is encouraged to place their one or more fingers in a specific location. In the most preferred embodiment as shown in FIG. 11, the physical restraints comprise a generally fingertip shaped enclosure 103. The physical restraints 102 further comprise an aperture 104 aligned with a nail 105 of a finger such that the printing apparatus 6 can print onto the nail 105 through the aperture 104. The safety elements further comprise an object detection camera 106 as shown in FIG. 10 for detecting the correct presence of the fingernail 105 and/or detecting any objects in areas where movement of any nail art printing apparatus 50 components may cause injury. The object detection camera has an associated software control program storable on the memory 44 of the electronic device 5, and executable thereform, which is configured to process the data from the object detection camera 106 to determine whether it is safe to print or to move the actuators.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

Embodiments of the invention may be implemented in hardware, firmware, software, or any combination thereof. Embodiments of the invention implemented in a computer system may include one or more bus-based interconnects between components and/or one or more point-to-point interconnects between components. Embodiments of the invention may also be implemented as instructions carried by or stored on a non-transitory machine-readable (e.g., computer-readable) medium, which may be read and executed by one or more processors. A machine-readable medium may be embodied as any device, mechanism, or physical structure for storing or transmitting information in a form readable by a machine (e.g., a computing device). For example, a machine-readable medium may be embodied as read only memory (ROM); random access memory (RAM); magnetic disk storage media; optical storage media; flash memory devices; mini- or micro-SD cards, memory sticks, and others.

In the drawings, specific arrangements or orderings of schematic elements, such as those representing devices, modules, instruction blocks and data elements, may be shown for ease of description. However, it should be understood by those skilled in the art that the specific ordering or arrangement of the schematic elements in the drawings is not meant to imply that a particular order or sequence of processing, or separation of processes, is required. Further, the inclusion of a schematic element in a drawing is not meant to imply that such element is required in all embodiments or that the features represented by such element may not be included in or combined with other elements in some embodiments.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof.

The invention claimed is:

1. A nail art printing apparatus having a receiving means for the placement of a nail or plurality of nails, the nail art printing apparatus being connectable to an electronic device, the electronic device having an interface means being operably engagable with the nail art printing apparatus, the nail art printing apparatus being operable to apply a plurality of colors or designs to one or more natural and/or artificial nails, and a safety means for preventing injury to a finger or plurality of fingers placed into the receiving means from any mechanisms or electronics of the nail art printing apparatus, wherein the safety means comprises at least one resistance sensor configured to detect any resistance to the movement of one or more moving components of the nail art printing apparatus over and above the normal resistance encountered by the movable components.

2. The nail art printing apparatus as claimed in claim 1, wherein the safety means includes a physical structure of the receiving means being designed such that a user is prevented from placing one or more fingers in an area proximal to moving parts or electronics.

3. The nail art printing apparatus as claimed in claim 1, wherein the safety means includes means for reversing the movement of the movable components so as to effect reverse movement in a direction opposite to that which experienced resistance via the control of an actuator associated with the moving components which experienced the resistance.

4. The nail art printing apparatus as claimed in claim 3, wherein the safety means includes one or more physical restraints for guiding one or more fingers into a specific location.

5. The nail art printing apparatus as claimed in claim 4, wherein the one or more physical restraints include a generally fingertip shaped enclosure having an aperture alignable with a nail of a finger such that the printer can print onto the nail through the aperture.

6. The nail art printing apparatus as claimed in claim 5, wherein the safety means includes an object detection means for detecting the location of objects in the nail printing area.

7. The nail art printing apparatus as claimed in claim 6, wherein the object detection means is a visual based sensor, wherein the visual based sensor includes a camera.

8. The nail art printing apparatus as claimed in claim 7, wherein the object detection means includes an associated software control program storable on the memory means of the electronic device and executable therefrom, which is configured to process the data from the object detection means to determine whether it is safe to print.

9. The nail art printing apparatus as claimed in claim 1, wherein the printing apparatus includes a presence sensor for detecting the presence of one or more natural or artificial nails.

10. The nail art printing apparatus as claimed in claim 9, wherein the presence sensor includes a pressure sensor/optical sensor.

11. The nail art printing apparatus as claimed in claim 1, wherein the electronic device includes interface means for user operation.

12. The nail art printing apparatus as claimed in claim 11, wherein the interface means allows for the selection of the quantity of nails to be printed on or upon, and the interface means allows for switching between a setting for artificial and natural nails.

13. The nail art printing apparatus as claimed in claim 1, wherein the nail art printing apparatus is housed in an enclosure.

14. The nail art printing apparatus as claimed in claim 13, wherein the enclosure includes payment receiving means.

15. The nail art printing apparatus as claimed in claim 14, wherein the payment receiving means is connectable to the electronic device and comprises one of or a combination of slots for the intake of coins or cash, a card payment receiving means, wherein the card payment receiving means includes a magnetic card reader for receiving credit/debit/gift/store cards, or means being operable to utilise Near Field Communication (NFC) payments.

16. The nail art printing apparatus as claimed in claim 14, wherein the payment receiving means includes biometric identification means, wherein the biometric identification means includes a fingerprint scanner.

17. The nail art printing apparatus as claimed in claim 1, wherein the electronic device has an associated mobile device application installable on a user mobile device, wherein the user mobile device includes a smartphone or tablet.

18. The nail art printing apparatus as claimed in claim 17, wherein the mobile device application includes means for pre-purchasing nail art treatment.

19. The nail art printing apparatus as claimed in claim 18, wherein the mobile device includes means for obtaining a unique code from the associated mobile device application for entry into the electronic device or obtaining a QR code from the associated mobile device application, the electronic device in the enclosure being operable to scan the QR code on the mobile device.

20. The nail art printing apparatus as claimed in claim 1, wherein the nail art printing apparatus includes means for attaching one or more artificial nails to a body part.

* * * * *